US006351963B2

(12) United States Patent
Surber et al.

(10) Patent No.: US 6,351,963 B2
(45) **Date of Patent: *Mar. 5, 2002**

(54) REFRIGERATED SPEED RAIL APPARATUS

(76) Inventors: Jeffrey A. Surber, 7530 14th Ave., Kenosha, WI (US) 53143; Timothy R. Dinan, 5812 82nd St., Kenosha, WI (US) 53142

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/478,171

(22) Filed: Jan. 5, 2000

(51) Int. Cl.[7] ..... A47F 3/04
(52) U.S. Cl. ..... 62/246; 62/258; 62/440
(58) Field of Search ..... 62/258, 246, 249, 62/440, 376, 434

(56) References Cited

U.S. PATENT DOCUMENTS

| | | | | |
|---|---|---|---|---|
| D282,128 | S | 1/1986 | Bell et al. | |
| 4,916,917 | A | 4/1990 | Jackson, Jr. | |
| 4,949,552 | A | 8/1990 | Adams | |
| 5,209,358 | A | 5/1993 | Simard | |
| 5,237,835 | A | 8/1993 | Brochier | |
| 5,267,448 | A | 12/1993 | Van Den Heuvel | |
| 5,358,128 | A | 10/1994 | Belokin et al. | |
| 5,423,191 | A | 6/1995 | Bennett | |
| 5,427,276 | A | 6/1995 | Knuettel, II et al. | |
| 5,584,187 | A | 12/1996 | Whaley | |
| 5,832,743 | A | 11/1998 | Adamovsky | |
| 5,845,514 | A | 12/1998 | Clarke et al. | |
| 5,921,096 | A * | 7/1999 | Warren | 62/258 |
| 6,000,236 | A * | 12/1999 | Haasis | 62/258 |
| 6,058,731 | A * | 5/2000 | Byczynski et al. | 62/344 |

OTHER PUBLICATIONS

Excerpts from Random 87–88 Wholesale Bar & Restaurant Equipment Catalog. Rapids Wholesale Bar & Restaurant Equipment. Date: 1987–1988.

Excerpts from Glastender Bar Stars Of The '90's catalog. Glastender, Inc., 1455 Agricola Dr., Saginaw, MI, 48604–9700. Date on cover indicates that the date is prior to Jun. 1, 1995.

Excerpts from Johnson Enterprises, Inc. 1997 Beverage Dispensing Equipment Catalog. Johnson Enterprises, Inc. Date: 1997.

Excerpts from Frosty Factory of America, Inc. catalog. Frosty Factory of America, Inc. Date: Oct. 1997.

Excerpts from Foodservice Equipment Reports. Vol. 3, No. 9, p. 133. Date: Sep. 1999.

* cited by examiner

*Primary Examiner*—William E. Tapolcal
*Assistant Examiner*—Mohammad M. Ali
(74) *Attorney, Agent, or Firm*—Jansson, Shupe & Munger Ltd.

(57) ABSTRACT

The invention disclosed and claimed in this patent is an improved refrigerated speed rail apparatus. The speed rail permits organized storage of beverage containers and provides easy and rapid access to those containers. The included refrigeration system chills beverages stored in the speed rail apparatus thereby enhancing the flavor of those beverages.

20 Claims, 8 Drawing Sheets

REFRIGERATED SPEED RAIL APPARATUS

FIELD OF THE INVENTION

This invention is related generally to refrigeration technology and, more specifically, to an improved apparatus for storing and chilling beverage containers and other objects.

BACKGROUND OF THE INVENTION

A significant problem confronting restaurants, taverns, clubs and other establishments in the hospitality industry is the need to serve beverages to patrons in an efficient and flavorful manner. Most of the aforementioned establishments offer patrons a wide variety of beverages. These beverages are typically held in individual bottles or other types of containers. The number of containers which the establishment needs to keep on hand for its patrons can number in the hundreds.

Storage and retrieval of the containers holding these beverages can present logistical problems for the establishment. For instance, some beverages are requested more frequently than others. Containers holding these beverages need to be easily accessible to service personnel so that patrons can be rapidly and efficiently served. However, containers holding these more popular beverages can become mixed in with containers holding less popular beverages thereby slowing the speed with which the popular beverages can be retrieved and served.

The storage of beverages behind a bar or other service area is also problematic because space is typically limited. These work areas tend to be narrow and cramped and provide a minimum of space for personnel to move about, let alone store beverage containers. It may be possible to store containers away from the bar or service area but this remote storage slows the rate at which patron orders can be filled.

Some establishments have sought to solve these problems with respect to the storage and organization of beverage containers by using storage devices called "speed rails." Speed rails are ideal for storage of beverage containers which are used more frequently than others and for segregating those containers from other, less frequently used containers.

Speed rails are typically positioned for use behind a bar or service area where space is narrowly confined. Prior art speed rails are typically configured as rectangular trough-like containers which are elongate and narrow and have an open top through which containers may be rapidly inserted into and removed from the speed rail. These prior art speed rails include an inner chamber designed to hold the containers. The inner chamber is typically designed to confine the containers to arrangement in a single row. In this way more frequently used containers may be efficiently stored near the serving personnel thereby making the service of beverages easier and less time consuming. Prior art speed rail devices are commercially available from sources such as Superior Products Mfg. Co. of St. Paul, Minn.

In addition to container storage and organization problems, certain beverages require refrigeration in order to enhance the flavor of the beverage or prevent the beverage from spoilage. These beverage containers can be stored in walk-in refrigerators or other types of refrigerators. However, storage of beverage containers in these types of refrigerators is disadvantageous because the containers are more difficult to reach or are stored in a remote location away from the serving personnel. Moreover, these types of refrigeration devices require potentially limited storage space more appropriate for other uses.

Yet another problem stems from the fact that certain beverages may need to be refrigerated at temperatures below those of other beverages or articles found in a typical refrigerator. This may mean that the refrigerator temperature must be decreased, resulting in increased energy costs. In addition, other items in the refrigerator, such as food, may become damaged by the decreased temperature.

It would be a significant improvement in the art to provide a speed rail device which would provide rapid access to containers stored therein and which would efficiently chill those containers without the disadvantages associated with the prior art devices.

Objects of the Invention

It is an object of this invention to provide an improved speed rail device overcoming problems and shortcomings of the prior art.

Another object of this invention is to provide an improved refrigerated speed rail device which enables rapid and efficient service of beverages to customers.

A further object of this invention is to provide an improved refrigerated speed rail device which can be used to chill beverages to a predetermined temperature.

Yet another object is to provide an improved refrigerated speed rail device which can chill beverages without bringing the heat-transfer-medium into contact with the beverages or the beverage containers thereby avoiding contamination.

It is also an object of this invention to provide an improved refrigerated speed rail device which avoids spillage of the heat-transfer-medium.

An additional object of this invention is to provide an improved refrigerated speed rail device which is compact and organizes containers stored therein.

Another object of this invention is to provide an improved refrigerated speed rail device which is convenient to use.

A further object of this invention is to provide an improved refrigerated speed rail device which can use a variety of different refrigeration devices located at positions within and remote from the speed rail.

One additional object of this invention is to provide an improved refrigerated speed rail device which can be mounted or positioned in different manners.

How these and other objects are accomplished will be apparent from the descriptions of this invention which follow.

SUMMARY OF THE INVENTION

Figure 1:
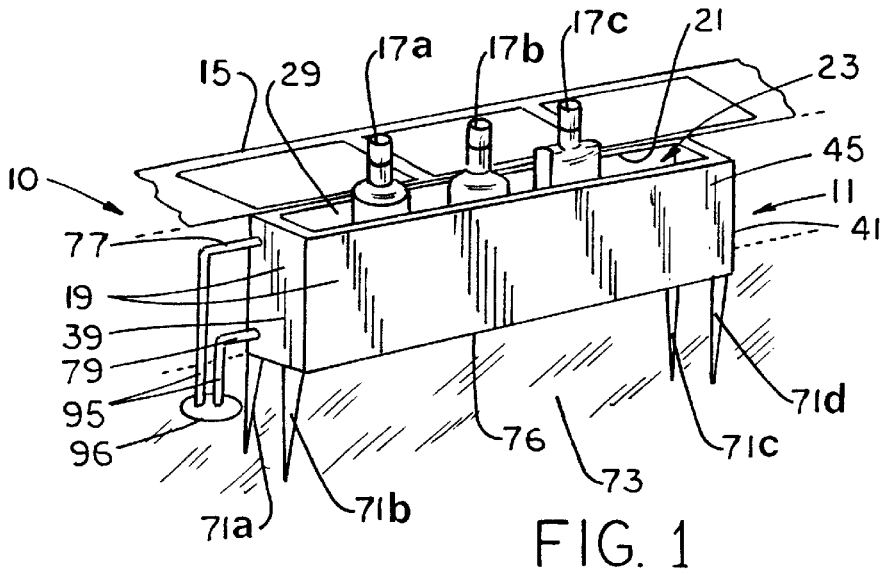
FIG. 1 is a perspective view of an exemplary speed rail container housing.

The present invention is a refrigerated speed rail apparatus. By use of the term "speed rail" we mean a device specifically intended for the storage of beverage containers and other objects incident to the storage of said containers, such as glassware, condiments and the like. The purpose of the invention is to improve the service of certain chilled beverages. This objective is accomplished by providing a speed rail from which beverage containers may be rapidly placed into, and removed from, the speed rail device thereby contributing to the organization of the containers and permitting rapid access to those containers. In addition, the speed rail enhances the flavor of beverages stored therein by refrigerating those beverages in a way which avoids contamination of the beverages and the beverage containers.

It is envisioned that the device will have particular utility in restaurants, taverns, clubs and other hospitality industry establishments. However, the invention is not limited to these applications and can be used in any setting where efficient storage and service of beverages is desired.

It should be noted that the invention disclosed herein is described in terms of its preferred embodiments. The invention is intended to include other structure capable of achieving the desired result.

The preferred device is a refrigerated speed rail apparatus for storing and cooling one or more containers. An important aspect of the invention is that the speed rail is configured and designed to permit each container to be rapidly placed into, and removed from, the speed rail.

The speed rail includes a container housing which has an outer surface and an inner surface. A chamber is provided in the inner surface for storing the containers. The preferred chamber is of an open top design with a bottom wall and at least one sidewall defining a top opening. The container is inserted into the speed rail through the opening. The housing can be configured in a number of different ways. For example, the housing could be made of a one-piece polymeric material or other suitable material. Alternatively, the housing could consist of spaced apart inner and outer shells made of a material such as stainless steel.

Most preferably, the speed rail housing is elongate and is configured to receive a plurality of containers rather than just a single container. The preferred housing is further configured to confine the received containers to arrangement in a single row. A plurality of chambers may be present in the housing to provide, for example a tiered storage system.

A fluid passageway is positioned in the speed rail for receiving heat-transfer-medium from a refrigeration device. The passageway is positioned between the outer and inner surfaces of the housing and in thermally-conductive contact with the housing inner surface. A heat-transfer-medium is to be circulated in the passageway for cooling the chamber.

Preferred forms of the passageway include a fluid inlet for receiving heat-transfer-medium and a fluid outlet for discharging the heat-transfer-medium. The most highly preferred passageway takes the form of a tube in fluid connection with the inlet and outlet. Other passageways, such as cavities, can be utilized. Preferably, thermal insulation is provided in the housing.

One important advantage of the inventive speed rail housing is that the heat-transfer-medium does not come into direct contact with containers in the housing. This is different from certain prior art devices which require that the containers be immersed in a refrigerated bath in which the chilling medium might consist of brine or even a glycol solution. By preventing the heat-transfer-medium from coming into direct contact with the containers it is possible to avoid contamination of the beverage and the beverage container by the heat-transfer-medium.

It is envisioned that the chamber top opening will be open so that containers may be freely inserted into the chamber. However, this is not always the case and preferred versions of the invention may include a cover over a portion of the chamber top opening (such as a slotted flexible plastic flap) to partially enclose the chamber. A moveable cover over substantially the entire housing top opening may also be provided.

The speed rail housing may be supported in a variety of ways within the scope of the invention. For example, preferred forms of the invention may include brackets or other apparatus for attaching the housing to a surface such as the wall behind a bar. The speed rail may also rest on floor-mounted legs or other suitable support structure.

A refrigeration device is to be provided for supplying heat-transfer-medium to the passageway. Any device capable of supplying the appropriate heat-transfer-medium to the speed rail may be utilized in the invention. Preferred refrigeration devices include several components including a compressor for compressing and pressurizing heat-transfer-medium from the passageway, a condenser for condensing heat-transfer-medium from the compressor and a control for metering a predetermined amount of condensed heat-transfer-medium from the condenser into the passageway.

The heat-transfer-medium in this embodiment "evaporates" upon entry into the speed rail due to the decrease in pressure within the speed rail thereby causing the temperature of heat-transfer-medium in the passageway to decrease. Temperature of the heat-transfer-medium is regulated by a device, preferably a hot gas bypass valve, which mixes hot heat-transfer-medium from the compressor with heat-transfer-medium from the metering control as heat-transfer-medium enters the speed rail housing. This advantageous combination permits temperature within the chamber to be set at a predetermined level. The heat-transfer-medium in such a system preferably consists of a refrigerant capable of undergoing a phase transition as it is compressed, condensed and evaporates.

Another alternative form of refrigeration device could include a system for circulating a chilled heat-transfer-medium such as glycol or brine through the speed rail container housing. Such as refrigeration system would introduce chilled heat-transfer-medium into the speed rail container housing and would not rely on evaporation within the container housing to decrease the temperature of the heat-transfer-medium.

The location of the refrigeration device is not important. The refrigeration device may be positioned in the speed rail housing or may be at a location remote from the housing.

In alternative embodiments, the speed rail housings can be arranged as "modules" with more than one speed rail ganged together. In these embodiments at least a second container housing is provided and that housing is preferably in fluid connection with the first housing. Preferred forms of the second housing have a configuration and fluid passageway as described above with respect to the preferred form of the speed rail housing. The modules could be ganged in series or in parallel. A single refrigeration device could supply heat-transfer-medium to all of the speed rail container housings through appropriate conduits.

A variety of other optional features may be included. These features include rails or racks within the housing chamber for supporting objects to be chilled by the speed rail, such as fruit or chilled beverage glasses. One or more bars, hooks or other apparatus for holding towels and the like may also be provided.

DETAILED DESCRIPTION OF A PREFERRED EMBODIMENT

In general, the inventive speed rail 10 consists of one or more speed rail container housings 11 and a refrigeration system 13 for supplying heat-transfer-medium 33 (shown in FIG. 6 only) to the container housing 11. These components may be sold or fabricated together or separately. Each of these components will be described in greater detail as follows.

FIG. 1 shows a perspective view of an exemplary refrigerated speed rail container housing 11 of the invention. FIGS. 2–10 show other aspects of exemplary container housing 11, including alternative embodiments.

Container housing 11 is shown in FIG. 1 positioned in a tavern work area behind bar 15 which is one location at which the invention 10 can be used. Placement of container housing 11 closely adjacent to bar 15 would provide service personnel with excellent access to container housing 11 for the purpose of serving beverages to patrons at bar 15. Containers 17*a*–17*c*, in the form of bottles are shown positioned in container housing 11. In the embodiment shown in FIG. 1, container housing 11 is configured to permit the bottles I7*a*–17*c* to project beyond container housing 11. In the alternative embodiment shown in FIG. 2, container housing 11 fully encloses containers 17*d*–17*i*.

Figure 2:
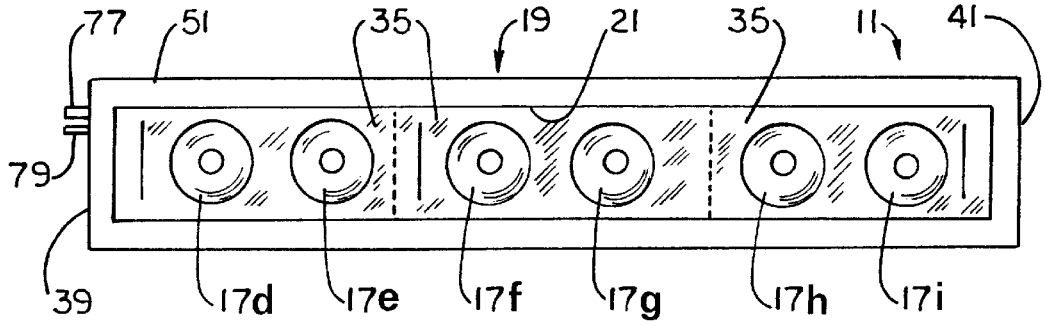
FIG. 2 is a top view of an exemplary container housing.

Housing 11 includes outer surface 19 and inner surface 21 shown best in FIGS. 1 and 2. Chamber 23 is formed by inner surface 19. Chamber 23 has a bottom wall 25 and at least one sidewall 27 (shown as sidewalls 27*a* –*d*) defining a top opening 29 through which containers 17 may be rapidly placed into and, subsequently, removed from chamber 23.

As shown in FIGS. 4–7, fluid passageway 31 is provided in container housing 11. Fluid passageway 31 is positioned between outer surface 19 and inner surface 21. Fluid passageway 31 is in thermally-conductive contact with housing inner surface 21. Fluid passageway 31 is configured to receive heat-transfer-medium 33 which is circulated in passageway 31 for cooling chamber 23.

The preferred container housing 11 shown in FIGS. 1–11 is elongate and chamber 23 is configured so that a single row of containers 17 may be placed in chamber 23. The width of chamber 23 is such that the containers 17 are confined to arrangement in a single row as shown particularly in FIGS. 1 and 2. Container housing 11 may include more than one chamber 23 (not shown) and the plural chambers may be arranged in other configurations, such as in tiers. The chamber 23 could be wide enough to accommodate a staggered arrangement of containers 17.

Figure 14:
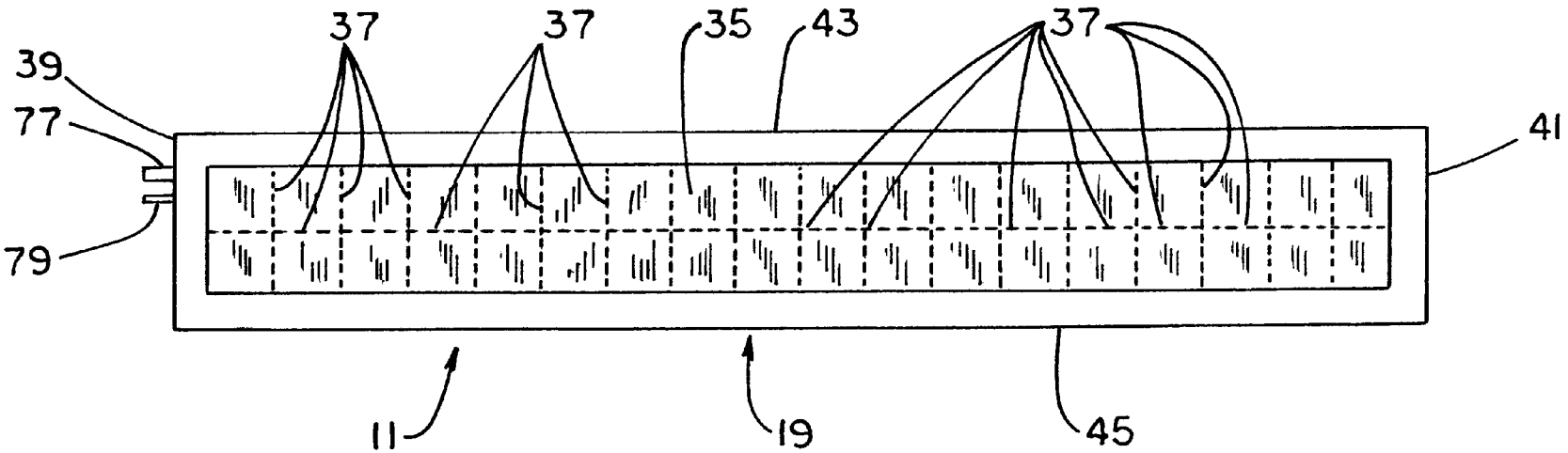
FIG. 14 is a top view of an exemplary container housing showing an exemplary cover.

FIG. 1 shows one embodiment in which chamber top opening 29 is completely open and unobstructed. In this embodiment, containers 17 are able to be freely placed into and removed from chamber 23. FIG. 2 shows an alternative embodiment in which a cover 35 is positioned across chamber top opening 29 to retain the temperature of containerized beverages in container housing 11. Cover 35 shown in FIG. 2 is configured to move to expose chamber 23. The movement may occur in any suitable manner such as through sliding or pivoting movement and cover 35 may be made of any suitable material. Clear plexiglass is ideal because it permits service personnel to see the objects in container housing 11. Alternative covers 35, such as the flexible, slotted flaps shown in FIG. 14 may be provided. In such alternative embodiment, containers 17*d*–17*i* are received into chamber 23 through the slots 37 (denoted by the horizontal and vertical dotted lines in FIG. 14) of cover 35 and cover 35 partially encloses chamber 23.

The construction of the exemplary container housings 11 as shown in FIGS. 1–11 is now described. Container housing 11 may be made of any suitable material. The container housing 11 shown in FIGS. 2–5 and 7–11 includes an inner surface 21 which is in the form of an inner shell. Outer surface 19 is in the form of an outer shell. Number 304 stainless steel is a preferred material for use in making the shells comprising outer 19 and inner 21 surfaces because it is easily formed and cleaned and has desirable durability.

Figure 6:
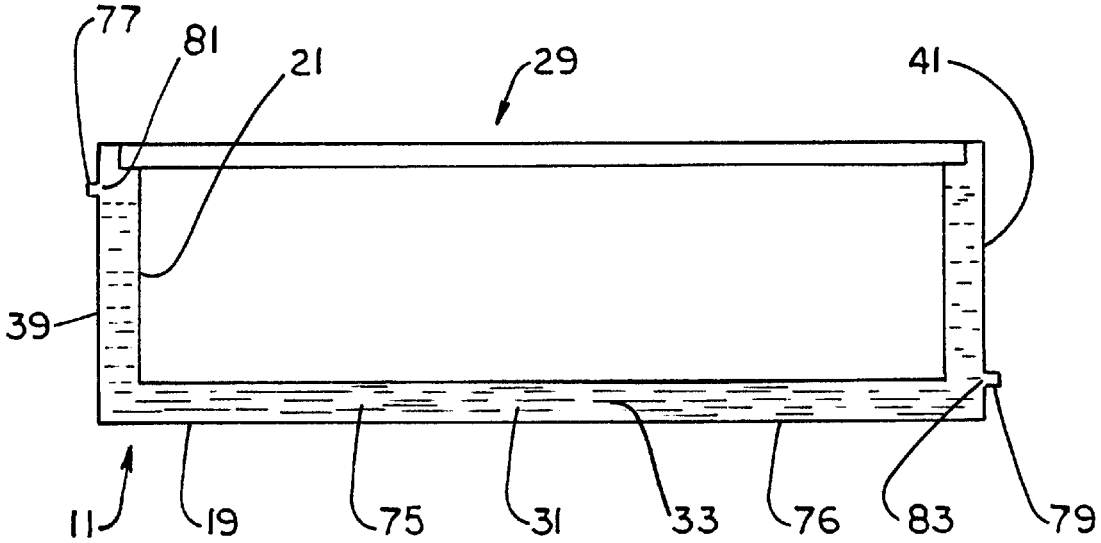
FIG. 6 is a side cross sectional view of an exemplary container housing showing a cavity as an alternative fluid passageway embodiment.
Figure 5:
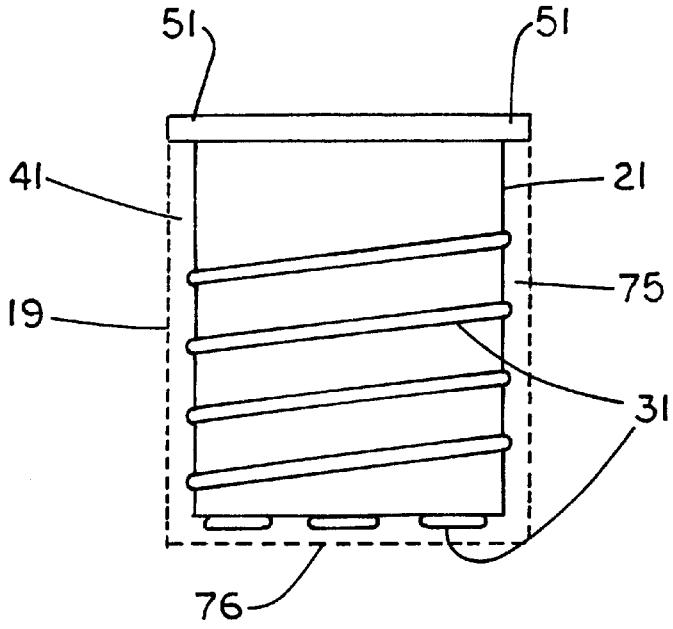
FIG. 5 is an end view of an exemplary container housing showing a tubular form of a fluid passageway.
Figure 7:
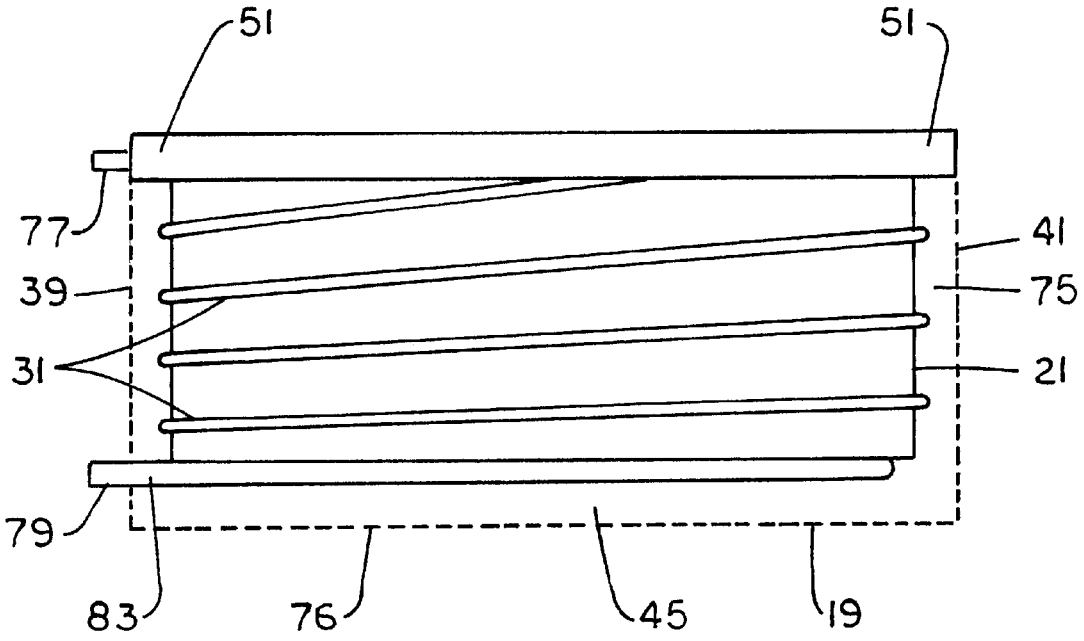
FIG. 7 is a side view of an exemplary container housing showing a tubular form of a fluid passageway.

Particularly as shown in FIGS. 5–7, inner surface 21 is substantially spaced apart from outer surface 19 (shown in phantom by dotted lines in FIGS. 5 and 7) to accommodate fluid passageway 31 which will be described in more detail below.

Figure 8:
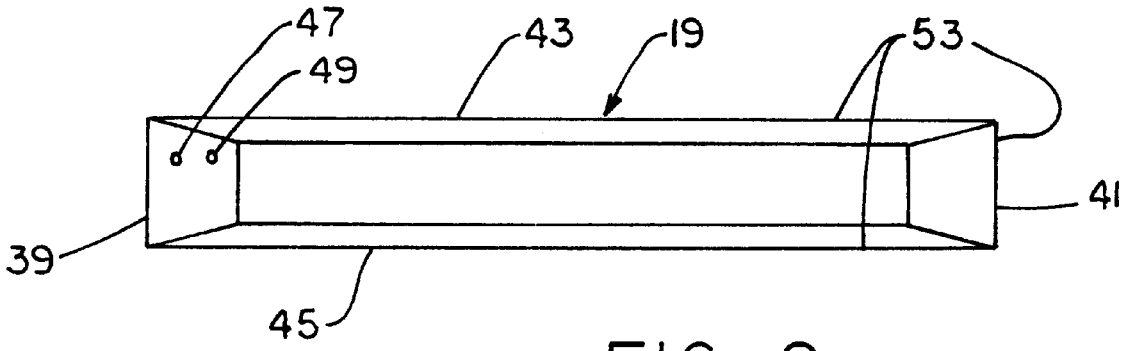
FIG. 8 is a top view of an outer shell structure of an exemplary container housing.
Figure 9:
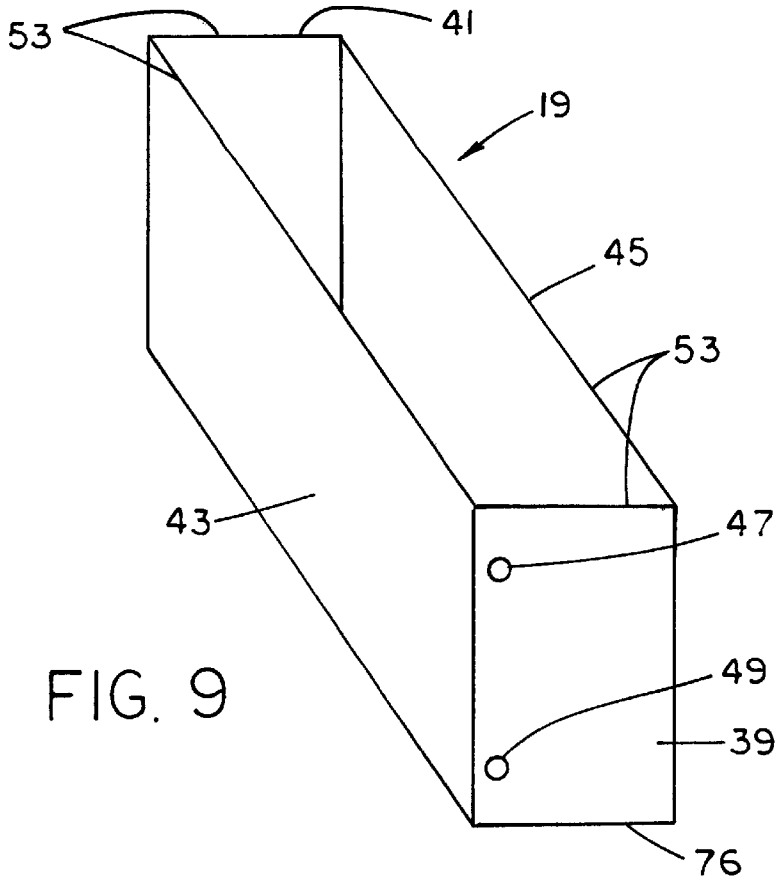
FIG. 9 is a perspective view of an outer shell structure of an exemplary container housing.
Figure 10:
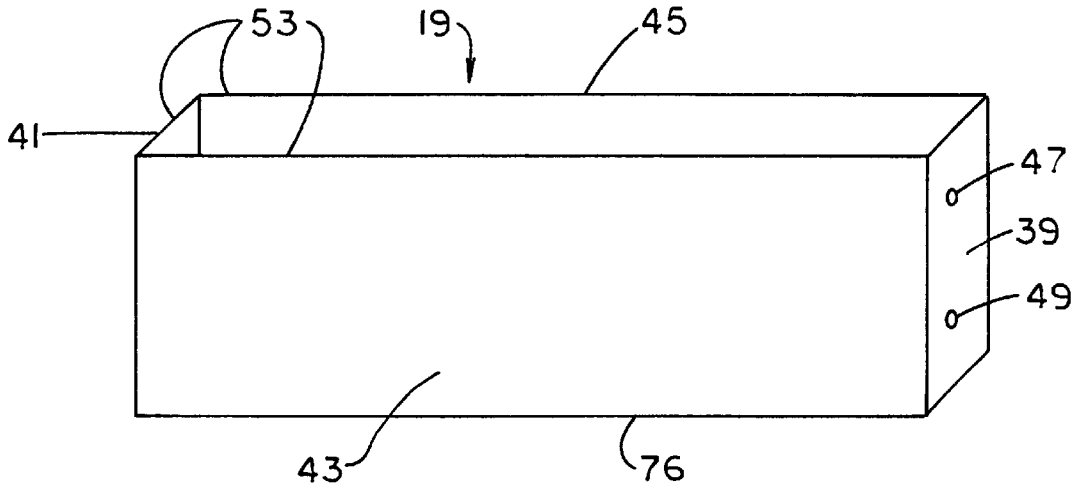
FIG. 10 is a perspective view of an outer shell structure of an exemplary container housing.

As shown in the embodiment of FIGS. 8–10, outer surface 19 is provided in the form of an outer shell. Outer surface 19 is preferably trough-shaped with first 39 and second ends 41 and first 43 and second 45 outer sidewalls. End 41 is provided with holes 47 and 49 through which the preferred tubular form of fluid passageway 31 is positioned.

Figure 3:
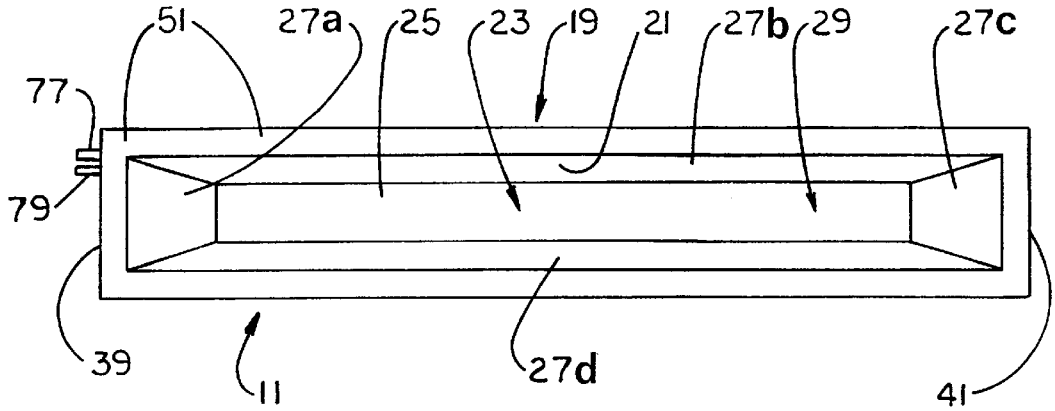
FIG. 3 is a top view of an inner shell structure of an exemplary container housing.

Inner surface 21, in the form of an inner shell, is shown in FIGS. 3, 5 and 7. In this embodiment, inner surface 21 is of a formed metal construction and is intended to be nested within outer surface 19. Shoulder 51 is provided around inner surface 21. Shoulder 51 abuts outer surface upper edge 53 and may be secured to outer surface through suitable means such as with fasteners 55 (not shown) or welds.

Figure 11:
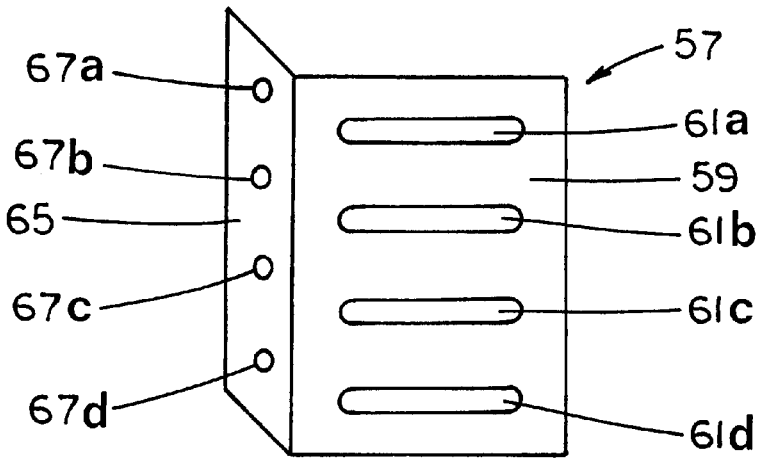
FIG. 11 is an exemplary mounting bracket.

FIG. 11 shows one exemplary apparatus, in the form of a bracket 57, for attaching container housing 11 to a wall surface 69 (not shown). For example, a pair of brackets 57 could be provided. Each bracket 57 is "L" shaped in top end section and has a first surface 59 with elongate slots 61*a*–61*d* which are secured by fasteners 63 (not shown) to ends 39 and 41 by fasteners 65 (not shown). Bracket second surface 65 has eyelets 67*a*–67*d* through which fasteners 68 (not shown) can be inserted to secure container housing 11 on a wall surface 69 (not shown). Legs 71*a*–71*d* (FIG. 1) can also be provided to support container housing 11 on a floor surface 73.

Figure 4:
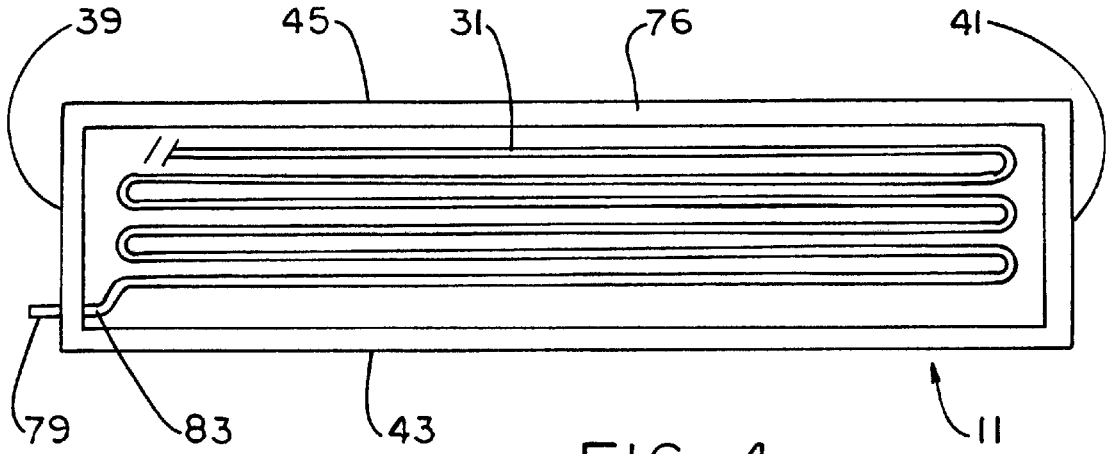
FIG. 4 is a bottom view of an exemplary speed rail container housing showing a fluid passageway which is a tube.

A preferred form of fluid passageway 31 is shown in FIGS. 4, 5 and 7. FIG. 4 is a bottom view showing a cut away of outer surface 19 showing fluid passageway 31 along the bottom side 76 of container housing 11. FIG. 5 shows an end view of container housing 11 in which outer surface 19 end 41 is shown in phantom by dotted lines while FIG. 7 is a side view in which outer surface 19 side 45 is shown in phantom by dotted lines.

It is preferred that fluid passageway 31 is a hollow copper tube which may be positioned in the space 75 between outer 19 and inner 21 surfaces. Such tube may be arranged in any suitable configuration. Fluid passageway 31 has a fluid inlet 77 and a fluid outlet 79 through which heat-transfer-medium 33 is received and discharged respectively from passageway 31. Passageway 31 has a first end 81 in fluid connection with inlet 77 and a second end 83 in fluid connection with outlet 79. Passageway 31 is designed so that heat-transfer-medium 33 may be circulated throughout passageway 31 so as to withdraw heat from within chamber 23 cooling beverages in containers 17. Optional thermal insulation 85 (not shown) may be provided in space 75 to maintain the temperature with chamber 23.

Container housing 11 is not limited to the above-described structure. Container housing 11 could, for example, be configured in different shapes and sizes. For example, container housing 11 could be round or square or could be truncated and configured to hold a single container 17 rather than multiple containers 17*a*–17*i* such as shown in FIGS. 1 and 2. Inner surface walls 27*a* and 27*c* could be curved rather than rectilinear. Container housing 11 could be made of materials other than metal. For example, container housing 11 could be made of a molded or polymeric material with fluid passageway 31 shown in the form of a cavity such as in FIG. 6. Inlet 77 and outlet 79 are in fluid connection with passageway 31 and heat-transfer-medium 33 is circulated within the cavity comprising this alternative form of passageway 31. Useful additional structure, such as an external towel hook 91 (not shown), can be provided. Another useful feature which could be included is a rack structure 93 (not shown) within housing chamber 23 for supporting objects such as glasses or mugs (not shown) to be chilled by the speed rail 10.

Figure 12:
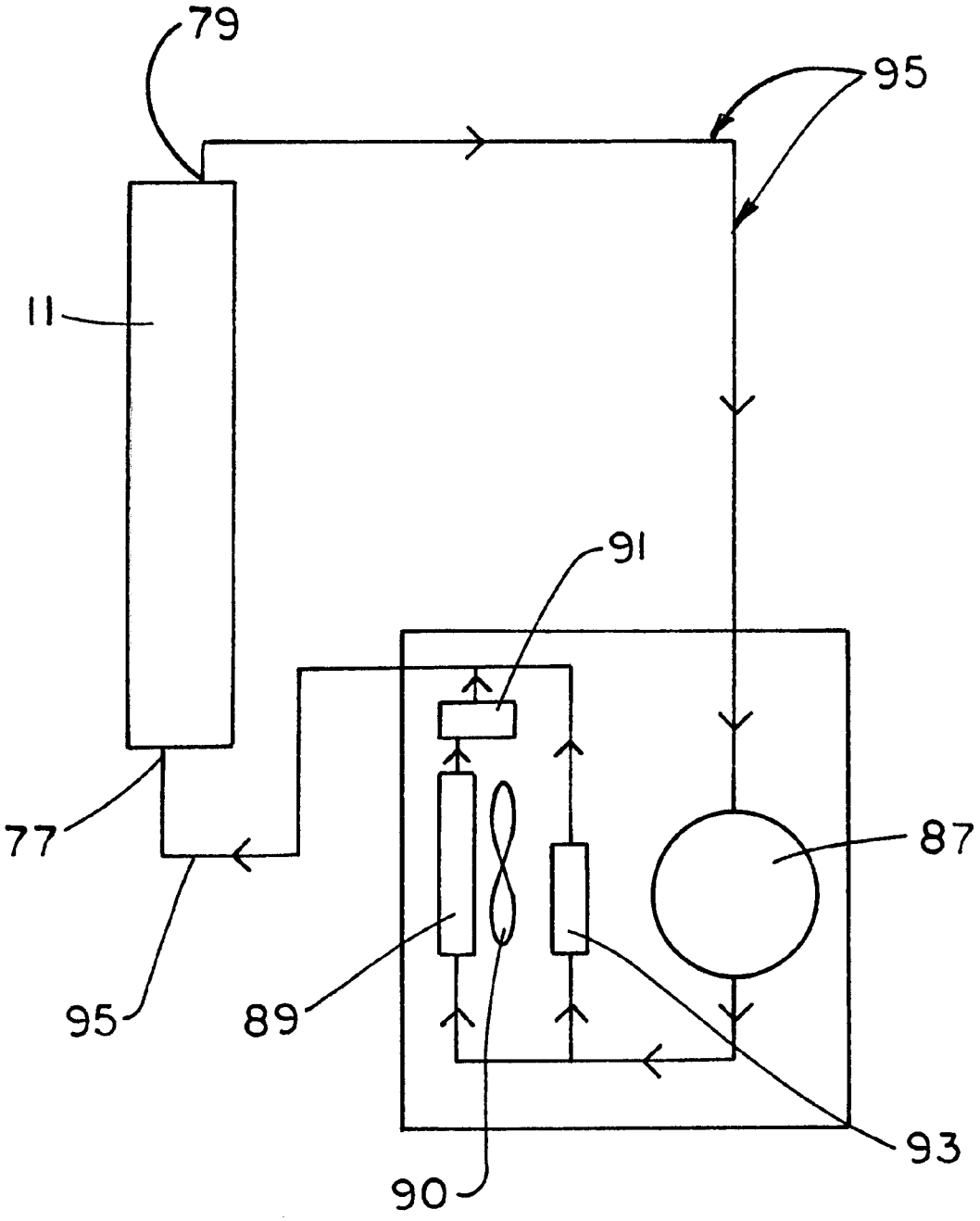
FIG. 12 is a schematic drawing of a refrigerant-based refrigeration system for use in one embodiment of the invention.

Different types of refrigeration systems 13 are suitable for use with the speed rail invention 10. The refrigeration system 13 may, for example, include systems which utilize a heat-transfer-medium 33 such as Genetron 134A refrigerant available from Allied Signal, Inc. Morristown, New Jersey. A schematic drawing for such a system is shown in FIG. 12. Other refrigeration systems 13 which use other heat-transfer-mediums 33 such as chilled brine, glycol, ammonia or even water can also be used and a schematic drawing of such a system is provided in FIG. 13. Other refrigeration systems 13 known to those of skill in the art, such as thermal electric refrigeration systems, conduction and convection systems may be used. In each such system the components are selected based on the system requirements.

The exemplary refrigerant-based system 13 of FIG. 12 will first be described. Such system 13 comprises a compressor 87 for compressing and pressurizing heat-transfer-medium 33 discharged from container housing 11. A suitable compressor 87 for use in the refrigeration system is a model AEA 13604XAXA compressor available from Tecumseh. A condenser 89 with fan 90 for condensing heat-transfer-medium 33 and withdrawing heat from heat-transfer-medium is provided downstream of the compressor 87. A Tecumseh 1/5 hp. condensing unit model # AEA 13604XAXA 2A528-1 is suitable for use in the refrigeration system 13.

Downstream of condenser 89 is a control 91 for metering a predetermined amount of condensed heat-transfer-medium 33 from condenser 89 into fluid passageway 31. Metering control 91 is a capillary tube with an interior diameter of 0.031 inches and an approximate length of 4.5 feet. Such a capillary tube is available from ILLCO, Inc. of Waukegan, Ill.

Valve 93 is provided between compressor 87 and condenser 89 for delivering a predetermined amount of compressed heat-transfer-medium 33 from compressor 87 into fluid passageway 31 is provided. Valve 93 is preferably a hot gas bypass valve such as an Alco Controls model #ACP9IE valve. Valve 93 supplies hot heat-transfer-medium 33 to fluid passageway 31 to regulate the temperature of the heat-transfer-medium 33 as it is introduced into container housing 11.

In this exemplary system, the container housing 11 acts as an evaporator. Condensed refrigerant heat-transfer-medium 33 from metering control 91 and hot heat-transfer-medium 33 from valve 93 are mixed in preselected ratios and are introduced into container housing 11 fluid inlet 77 and fluid passageway 31. The pressure in passageway 31 is less than the pressure in conduit 95 causing a decrease in the temperature of heat-transfer-medium 33 in fluid passageway 31 and causing a heat transfer with containers 17 in chamber 23. The temperature within chamber 23 can be set at a predetermined level based upon the ratio of heat-transfer-medium 33 from control 91 and from valve 93. Other forms of known temperature controls, such as thermostats, could be used to regulate the temperature within container housing 11. Heat-transfer-medium 33 is discharged from fluid outlet 79 to compressor 87 to complete the cycle. A Watsco spun copper drier model #712 (not shown) may be provided in fluid connection with conduit 95 to eliminate any moisture in refrigeration system 13.

Variation in this system is intended. For example, a plurality of container housings 11 may be ganged together with heat-transfer-medium 33 discharged from one container housing 11 received into a downstream container housing 11*a*. In addition, the refrigeration system 13 may be positioned in container housing 11. Alternatively, the refrigeration device 13 may be positioned remote from container housing 11. Such a remote system 13 would be connected to container housing 11 with an appropriate conduit 95, such as copper tubing. FIG. 1 shows such an exemplary device in which refrigeration system 13 is positioned at a remote location such as in a basement (not shown) below container housing 11. FIG. 1 shows conduit 95 in fluid connection with fluid inlet 77 and fluid outlet 79 for transferring heat-transfer-medium 33 into and out of container housing 11 respectively. Conduit 95 passes through floor opening 96 to refrigeration system 13 below.

Figure 13:
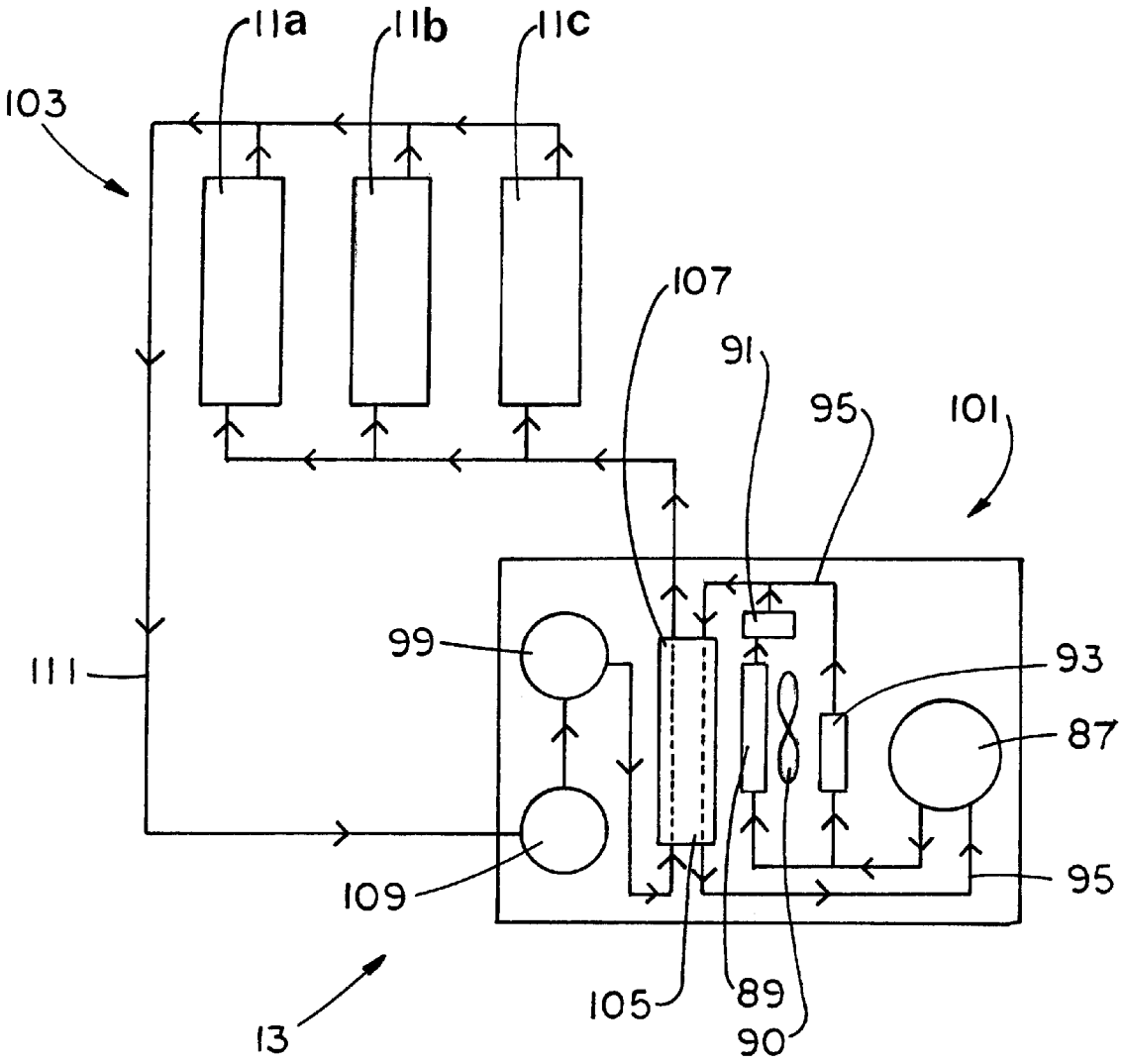
FIG. 13 is a schematic drawing of another refrigeration system for use in one embodiment of the invention which includes a refrigerant-based system in combination with a chilled heat-transfer-medium system.

The exemplary refrigeration system 13 of FIG. 13 chills the contents of container housings 11*a*–11*c* with a heat-transfer-medium 33 consisting of chilled glycol, brine or another fluid which can be chilled. This system 13 is remote from container housing(s) 11 and consists of a refrigerant-based system 101 which uses a refrigerant heat-transfer-medium 33 to chill a non-refrigerant heat-transfer-medium 33 (such as glycol or brine) which is then delivered to container housings 11*a*–11*c* by a separate refrigeration system 103.

The refrigerant-based system 101 of FIG. 13 can be like the system of FIG. 12. A compressor 87 compresses a refrigerant heat-transfer-medium (such as Genetron R134A) which is then supplied to a condenser 89 and a control 93. Condensed heat-transfer-medium 33 from condenser 89 is supplied to evaporator 105 from metering control 91 whereupon a decrease in pressure within evaporator 105 causes heat-transfer-medium 33 to expand and become cold. Temperature within evaporator 105 is regulated by the amount of hot heat-transfer-medium supplied from control 93 just before introduction of heat-transfer-medium 33 into evaporator 105. A Watsco spun copper drier model #712 (not shown) may be provided in fluid connection with conduit 95 to eliminate any moisture in the system 101.

The separate refrigeration system 103 includes a heat-exchange portion 107 of conduit 111 provided in thermally-conductive contact with evaporator 105. Heat-transfer-medium is circulated through conduit portion 107 in evaporator 105 by pump 99 whereupon it is chilled. The chilled heat-transfer-medium 33 is then circulated through one or more container housings 11*a*–11*c* causing containers 17 (not shown) in such housings to become chilled. Heat-transfer-medium 33 discharged from container housings 11*a*–11*c* is circulated into pressure-relief tank 109 and to pump 99 whereupon the cycle is repeated. In this system, container housings 11*a*–11*c* do not act as evaporators.

The container housings 11 in this embodiment could be located in any suitable location. The container housings 11 utilized in this alternative system may be configured and arranged as those above. Any number of housings 11 could be used in this exemplary system. All of the components are connected with appropriate conduit 111 such as copper tube.

In operation, each container housing 11*a*–11*c* is positioned in a suitable location where rapid and efficient service of chilled beverages is desired. Containers 17 are arranged within each chamber 23 in an orderly fashion by the confining configuration of each chamber 23. The containers 17 may be rapidly removed from and placed into each container housing 11 as is the nature of a speed rail device.

The refrigeration system 13 circulates chilled heat-transfer-medium 33 through each container housing 11*a*–11*c* and the heat-transfer-medium 33 is in thermal connection with each inner surface 21 and chamber 23. Heat transfer occurs between containers 17 in each chamber 23 and heat-transfer-medium 33. As a result, the containers may be chilled to a predetermined temperature. That temperature may be below 32° F. for beverages containing alcohol as such beverages have a freezing point below that of water.

The invention permits beverages to be served quickly and easily thereby making the work of service personnel easier. The invention increases beverage quality over that of other beverage chilling devices because the heat-transfer-medium 33 never comes into direct contact with the containers 17 and does not have the opportunity to contaminate those containers 17 or the beverages held therein. Customer satisfaction is further increased by the flavor enhancement that refrigeration provides to many beverages.

While the principles of this invention have been described in connection with specific embodiments, it should be understood clearly that these descriptions are made only by way of example and are not intended to limit the scope of the invention.

What is claimed:

1. A refrigerated speed rail apparatus for storing and cooling liquid-holding containers, the speed rail being configured and designed to permit the liquid-holding containers to be rapidly placed into, and removed from, the speed rail comprising:

a housing for receiving the liquid-holding containers, the housing having wall structure including inner and outer surfaces and bottom wall, front wall, back wall and end wall portions each of which has a horizontal length dimension, the horizontal length dimensions of the bottom wall, front wall and back wall portions each being substantially greater than those of the end wall portions whereby the housing is adapted to extend along a elongate service area;

the inner surface forming an elongate chamber having an unobstructed chamber top opening through which the liquid-holding containers may be rapidly placed into and, subsequently, removed from the chamber, the chamber having a length such that a plurality of containers may be received therein, a height such that the liquid-holding containers are substantially within the chamber and front and back wall portions spaced apart such that the chamber laterally confines the liquid-holding containers in an upright position arranged in a single row; and a fluid passageway for receiving heat-transfer-medium from a refrigeration device, the passageway being positioned between the outer and inner surfaces in thermally-conductive contact with the housing inner surface and through which heat-transfer-medium, when received in the passageway, is circulated for cooling the chamber.

2. The speed rail apparatus of claim 1 wherein the housing includes a plurality of housing chambers.

3. The speed rail apparatus of claim 1 further including a cover partially enclosing the chamber top opening thereby allowing a liquid-holding container to be inserted into and removed from the chamber.

4. The speed rail apparatus of claim 1 further including a cover mounted for movement between a first position in which the chamber top opening is substantially closed and a second position in which the chamber top opening is substantially open.

5. The speed rail apparatus of claim 1 further including apparatus for attaching the housing to a wall surface.

6. The speed rail apparatus of claim 1 further including support structure for supporting the apparatus on a floor surface.

7. The speed rail apparatus of claim 1 wherein the passageway has an inlet in fluid connection with the passageway for receiving heat-transfer-medium and an outlet in fluid connection with the passageway for discharging the heat-transfer-medium.

8. The speed rail of claim 7 wherein the passageway is a tube having a first end in fluid connection with the inlet and a second end in fluid connection with the outlet.

9. The speed rail apparatus of claim 8 further including insulation positioned in the housing and about the conduit.

10. The speed rail apparatus of claim 1 further including a refrigeration device for supplying heat-transfer-medium to the passageway.

11. The speed rail apparatus of claim 10 wherein the refrigeration device comprises:

a compressor for compressing and pressurizing heat-transfer-medium from the passageway;

a condenser for condensing heat-transfer-medium from the compressor;

a control for metering a predetermined amount of condensed heat-transfer-medium from the condenser into the passageway whereupon a decrease in pressure causes a decrease in the temperature of heat-transfer-medium in the passageway; and a device for mixing heat-transfer-medium from the compressor with heat-transfer-medium from the metering control to regulate the temperature of the heat-transfer-medium;

whereby, temperature within the chamber can be set at a predetermined level.

12. The speed rail apparatus of claim 11 wherein the mixing device comprises a hot gas bypass valve.

13. The speed rail apparatus of claim 10 wherein the refrigeration device is positioned in the housing.

14. The speed rail apparatus of claim 10 wherein the refrigeration device is remote from the housing.

15. The refrigeration device of claim 1 wherein the housing comprises a first housing and the refrigerated speed rail device further includes at least one additional housing which may be placed in fluid connection with the first housing, said at least one additional housing comprising:

wall structure including inner and outer surfaces and bottom wall, front wall, back wall and end wall portions each of which has a horizontal length dimension, the horizontal length dimensions of the bottom wall, front wall and back wall portions each being substantially greater than those of the end wall portions whereby said at least one additional housing is adapted to extend along a elongate service area;

the inner surface forming an elongate chamber having an unobstructed chamber top opening through which the bottles may be rapidly placed into and, subsequently, removed from the chamber, the chamber further having a length such that a plurality of containers may be received therein, a height such that the bottles are substantially within the chamber and front and back wall portions spaced apart such that the chamber confines the containers in an upright position arranged in a single row; and a fluid passageway in said at least one additional housing which may be placed in fluid connection with the fluid passageway of the first housing for receiving heat-transfer-medium from a refrigeration device, the passageway of said at least one additional housing being positioned between the outer and inner surfaces of said at least one additional housing in thermally-conductive contact with the inner surface of said at least one additional housing and through which heat-transfer-medium, when received in the passageway of at least one additional housing, is circulated for cooling the chamber of said at least one additional housing.

16. The speed rail apparatus of claim 15 wherein the refrigeration device is remote from the housings and comprises:

a compressor for compressing heat-transfer-medium;

a condenser for condensing heat-transfer-medium from the compressor;

an evaporator for decreasing the temperature of the heat-transfer-medium;

a pump for supplying chilled heat-transfer-medium from the evaporator to the housings; and a reservoir for relieving pressure within the refrigeration device.

17. The speed rail apparatus of claim 15 wherein the refrigeration device is remote from the housing and comprises:

a compressor for compressing and pressurizing heat-transfer-medium from the passageway of each housing;

a condenser for condensing heat-transfer-medium from the compressor;

a control for metering a predetermined amount of condensed heat-transfer-medium from the condenser into each passageway whereupon a decrease in pressure causes a decrease in the temperature of the heat-transfer-medium; and a device for mixing heat-transfer-medium from the compressor with heat-transfer-medium from the metering control to regulate the temperature of the heat-transfer-medium;

whereby, temperature within the chamber can be set at a predetermined level.

18. The speed rail apparatus of claim 15 further including a heat-transfer-medium in each passageway.

19. The speed rail apparatus of claim 16 wherein the heat-transfer-medium is selected from the group consisting of glycol and brine.

20. The speed rail apparatus of claim 15 further including a moveable cover over substantially all of each housing top opening.

* * * * *